US005417277A

United States Patent [19]

Le Gauyer

[11] Patent Number: 5,417,277

[45] Date of Patent: May 23, 1995

[54] FLUID MANIFOLD HAVING A TUBULAR WALL, FOR A HEAT EXCHANGER

[75] Inventor: Philippe Le Gauyer, Paris, France

[73] Assignee: Valeo Thermique Moteur, Le Mesnil-Saint-Denis, France

[21] Appl. No.: 953,103

[22] Filed: Sep. 29, 1992

[30] Foreign Application Priority Data

Oct. 1, 1991 [FR] France ..... 91 12062

[51] Int. Cl.[6] ..... F23F 1/32; F23F 9/16

[52] U.S. Cl. ..... 165/76; 165/153; 165/173; 29/890.52

[58] Field of Search ..... 165/173, 175, 76, 153; 29/890.52

[56] References Cited

U.S. PATENT DOCUMENTS

| | | | |
|---|---|---|---|
| 4,582,127 | 4/1986 | Moranne | 165/173 |
| 4,759,405 | 7/1988 | Metzger | 165/173 |
| 4,881,594 | 11/1989 | Beamer et al. | 165/173 |
| 5,052,480 | 10/1991 | Nakajima et al. | 165/173 |
| 5,107,926 | 4/1992 | Calleson | 165/173 |

FOREIGN PATENT DOCUMENTS

| | | | |
|---|---|---|---|
| 0198581 | 10/1986 | European Pat. Off. | 165/173 |
| 904498 | 8/1962 | United Kingdom | 165/173 |
| 2049149 | 12/1990 | United Kingdom . | |

*Primary Examiner*—Albert W. Davis, Jr.
*Attorney, Agent, or Firm*—Mogran & Finnegan

[57] ABSTRACT

A heat exchanger, such as a condenser for a motor vehicle air conditioning installation, has a fluid manifold comprising a tubular wall having a number of through apertures in which the ends of fluid flow tubes of the heat exchanger are fitted. These apertures are aligned in the axial direction. In the region of the tubular wall lying between two consecutive ones of the said apertures, the tubular wall is formed with a concavity or a flat extending in the circumferential direction. The tubular wall can thus be immobilized against rotation by applying it against a flat surface so that the flow tubes can be correctly introduced into the apertures.

7 Claims, 1 Drawing Sheet

FLUID MANIFOLD HAVING A TUBULAR WALL, FOR A HEAT EXCHANGER

FIELD OF THE INVENTION

This invention relates to heat exchangers of the kind comprising at least one fluid manifold having an elongated tubular wall, together with a multiplicity of parallel tubes which penetrate into the fluid manifold through apertures formed in the tubular wall of the latter.

BACKGROUND OF THE INVENTION

Such a heat exchanger, which is useful especially as a condenser in an air conditioning installation for a motor vehicle, is described in the specification of published European patent application No. EP 0 198 581A. In this known heat exchanger, the tubular wall has a convexity in each of its zones lying between two consecutive apertures for receiving the heat exchanger fluid flow tubes. This convexity extends outwardly, both in the longitudinal direction and in the transverse or circumferential direction. This transverse convexity makes it difficult to ensure that the tubular wall is immobilised against rotation about its axis during its assembly to the flow tubes of the heat exchanger. There is thus a danger that it will pivot under the force exerted by the tubes as they are introduced into the apertures, thus leading to wrong positioning of the fluid manifold with respect to the tubes, or even preventing their assembly from being carried out at all.

DISCUSSION OF THE INVENTION

An object of the invention is to overcome the above mentioned drawback.

To this end, according to the invention there is provided a fluid manifold for a heat exchanger, comprising a tubular wall formed with a multiplicity of through apertures which are aligned in the axial direction for receiving fluid flow tubes of the heat exchanger, characterised in that the said tubular wall, in each of the portions of its length which are delimited by the said apertures, is situated entirely on one side of a plane of contact which extends parallel to the axial direction of the tubular wall in facing relationship with the said apertures, with the said plane coming into engagement with the tubular wall in at least two points of contact which are spaced apart in the circumferential direction.

At least two said planes of contact, different from each other, may be defined, corresponding to different portions of the length of the tubular wall. Thus for example one plane of contact may be defined for the portion or portions of the length of the tubular wall within which a transverse wall or bulkhead is lodged, the periphery of the bulkhead being in contact with the inner surface of the tubular wall; with another plane of contact being defined for portions of the length of the tubular wall not having such a bulkhead.

With this configuration, the tubular wall is able to be applied in a stable manner, and without any danger of pivoting movement, either against one or more flat engagement surfaces on which the tubular wall is engaged through all of its contact points, or else on separate engagement elements, which are disposed in one or more planes on which the tubular wall is engaged through its different respective points of contact. Such a surface, or such engagement elements, may be used either for conferring a desired orientation on the tubular wall, which will be maintained by gripping means before the tubes are fitted, or during this fitting or assembly operation itself. In the latter case, the engagement elements mentioned above may if necessary be part of the bundle defined by the tubes and by cooling fins extending between them.

The apertures are preferably elongated in the circumferential direction and are symmetrical with respect to an axial plane of the tubular wall. The plane of contact will then be arranged to be at right angles to this axial plane of symmetry.

In one embodiment of the invention, the tubular wall is in engagement with the plane of contact in at least one straight segment at right angles to its axial direction. In particular, it may include a flat surface portion situated in the contact plane.

In another embodiment of the invention, the tubular wall has, between its two contact points, or between two zones of contact which are spaced apart in the circumferential direction (with each of these zones of contact extending over a particular axial length), a concavity which is open towards the contact plane. Such a concavity offers the advantage of improving the resistance of the tubular wall to pressure, as compared with the configuration that includes a straight transverse contact segment or a flat contact surface portion.

Contact segments, flat contact surface portions and zones of contact, such as mentioned above, whether identical or different from each other, are provided in each of the regions of the wall lying between two consecutive ones of the said apertures.

Further features and advantages of the invention will appear more clearly from the detailed description that follows, of preferred embodiments of the invention, given by way of example only and with reference to the accompanying drawings.

DESCRIPTION OF PREFERRED EMBODIMENTS OF THE INVENTION

Figure 1:
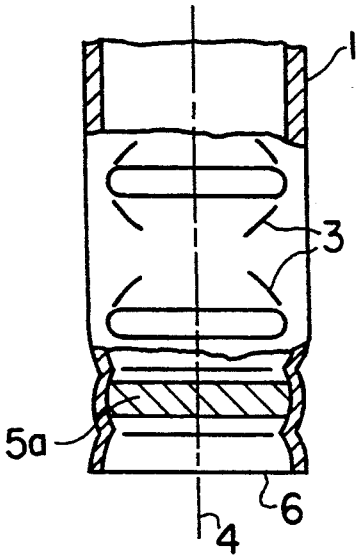
FIG. 1 is a view showing part of a fluid manifold in accordance with the invention, shown partly in cross section through an axial plane parallel to the contact plane.

The fluid manifold shown in the drawings is intended especially to form part of a condenser in an air conditioning installation for the cabin of a motor vehicle. It includes a tubular wall 1, which may in particular be formed from a rectangular metal sheet rolled into a cylindrical shape and welded edge-to-edge sealingly along a generatrix 2. A number of apertures 3 are formed through the wall 1. The apertures 3 are elongated in the circumferential direction and are aligned mutually in the direction of the axis 4 of the cylinder. The ends of fluid flow tubes of the condenser are received in these apertures 3.

Figure 2:
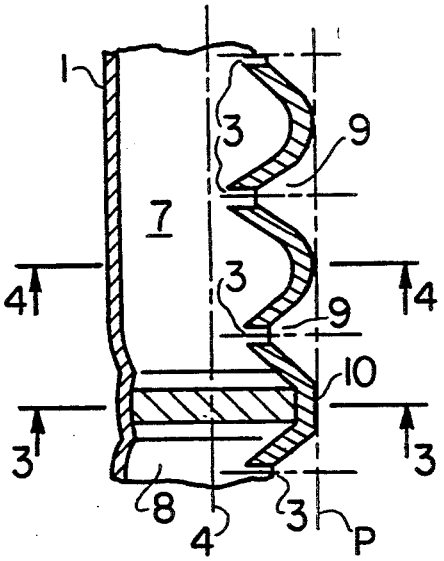
FIG. 2 is another view of part of the same fluid manifold, shown in cross section through its axial plane of symmetry.

The fluid manifold also includes a number of transverse bulkheads 5a, 5b, which consist of discs extending transversely within the tubular wall 1 and secured by crimping. These bulkheads 5a, 5b are brazed sealingly around their periphery to the inner surface of the wall 1. FIG. 1 shows such a bulkhead 5a disposed close to one axial end 6 of the wall 1 and constituting a terminal wall of the manifold. FIG. 2 shows an intermediate bulkhead 5b which separates two compartments 7 and 8 of the fluid manifold from each other. Some of the apertures 3 are open into the compartment 7, the others being open into the compartment 8. Each aperture 3 lies at the bottom of a respective depression 9 formed in the tubular wall 1.

Figure 3:
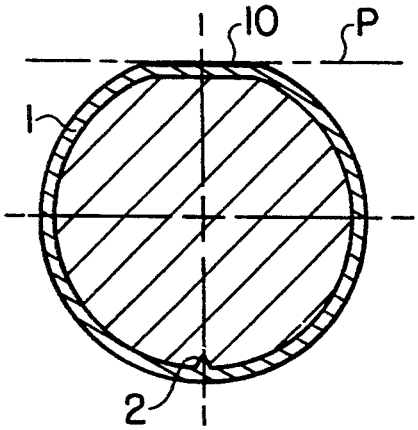
FIG. 3 is a cross sectional view taken on the line III—III in FIG. 2.

As can best be seen in FIGS. 2 and 3, the outer surface of the tubular wall 1 includes a surface portion 10. This lies in the region extending between two consecutive apertures 3, in radial alignment with the bulkhead 5b and corresponding with a flat portion of the periphery of the latter. The surface portion 10 lies in a plane P which is parallel to the axis 4 and at right angles to the longitudinal plane of symmetry of the wall 1. In other words, this outer surface portion 10 is flattened over a particular length, not only in the axial direction but also in the circumferential direction of the tubular wall 1.

Figure 4:
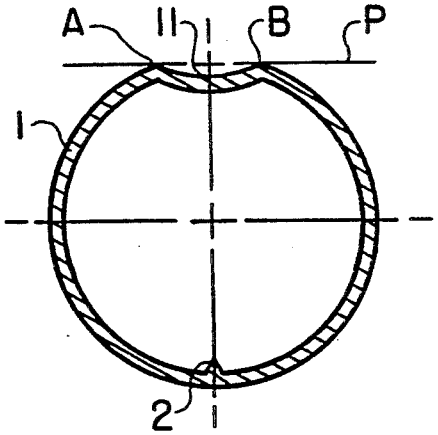
FIG. 4 is a cross sectional view taken on the line IV—IV in FIG. 2.

FIGS. 2 and 4 show how the tubular wall, halfway between two consecutive apertures and in a region not having a transverse bulkhead, is convex outwardly in the longitudinal direction but has a concavity 11 in the circumferential direction. It touches the plane P only in two points of contact A and B, which are spaced apart in the circumferential direction.

Figure 5:
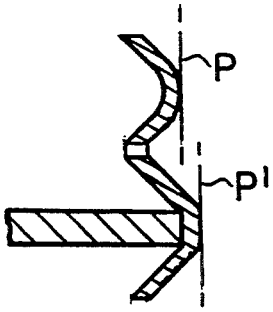
FIG. 5 is a cross-sectional view of a portion of a modified embodiment of a fluid manifold that characterizes the invention.

In a modification (shown in FIG. 5), the inward deformation of the tubular wall which defines the points of contact is limited by the presence of the transverse bulkheads, such as 5a and 5b, and is smaller, in those portions of the length of the wall 1 which include such bulkheads, than it is elsewhere. Accordingly, there are here two different contact planes P and P for the fluid manifold as a whole. One of which planes, P corresponding to the portions of the length of the tubular wall 1 not having any bulkhead, is closer to the axis of the tubular wall, while the other of these two planes, P which is that corresponding to the portions of the length of the wall which are provided with bulkheads, is spaced further away from the axis.

Other configurations than those described above by way of example are of course possible for the region of the tubular wall lying between two consecutive apertures. In particular, the tubular wall may be convex in the longitudinal direction and flattened in the circumferential direction, coming into contact with the plane P only in a straight segment extending in the circumferential direction. Alternatively it may be flattened in the longitudinal direction and concave in the circumferential direction, so as to come into contact with the plane P only along two lines which extend in the longitudinal direction and which are spaced apart in the circumferential direction. All of these configurations may be disposed, not only in line with a transverse bulkhead, but also in a region not having a transverse bulkhead.

As is already known, the apertures 3 may be formed either by cutting or by pressing. The flats and hollows may be obtained by locally deforming the tubular wall, preferably before the apertures 3 are themselves formed, so as to avoid changing the shape of the latter. The transverse bulkheads 5a, 5b may be formed before assembly with flats or circumferential hollows at their periphery, corresponding to those of the tubular wall. Alternatively, the bulkheads may be made circular, so that the deformation of the outer surface of the tubular wall is accompanied by a corresponding deformation of the bulkheads and/or a variation in thickness of the tubular wall.

What is claimed is:

1. A fluid manifold for a heat exchanger having a plurality of cooling fins comprising a manifold having a circumferential tubular wall with an inner face defining a longitudinal axis having an axial direction and having a multiplicity of apertures formed in the wall, the apertures being aligned in the axial direction, the apertures being circumferentially elongated, a plurality of fluid flow tubes each received in a respective one of the apertures to define between each aperture the next portion of the length of the tubular wall, the tubular wall further defining at least one plane of contact facing and spaced away from the apertures and extending parallel to the axial direction, wherein in each portion of the length of the tubular wall, the tubular wall lies entirely on one side of the at least one contact plane, and at least two circumferentially spaced contact points formed in at least one of the tubular wall portions to selectively engage at least one of the cooling fins on the contact points.

2. A fluid manifold according to claim 1, in which each of the tubular wall portions further comprise at least two points of contact corresponding to each of the different tubular portions along the length thereof to selectively engage at least one respective cooling fin thereon.

3. A fluid manifold according to claim 1, further comprising at least one transverse bulkhead having a periphery in engagement with the inner face of the tubular wall, a second plane of contact corresponding to the tubular portion to selectively engage at least one respective cooling fin thereon containing the transverse bulkhead being spaced further away from the longitudinal axis of the tubular wall than the plane of contact corresponding to the other tubular wall portion.

4. A fluid manifold according to claim 1, wherein the tubular wall further comprises an axial plane at right angles to the at least one plane of contact, the apertures each being symmetrical with respect to the axial plane.

5. A fluid manifold according to claim 1, wherein the tubular wall further comprises a flattened surface, the flattened surface coinciding with at least one of the planes of contact parallel with the longitudinal axis to selectively engage at least one respective cooling fin thereon.

6. A fluid manifold according to claim 1, further comprising at least two zones of contact between the manifold and at least two planes of contact, the zones of contact each being individual to a respective one of the planes, each of the zones being spaced away from the longitudinal axis of the tubular wail and the aperture formed thereon, with each of the zones of contact extending in the axial direction of the tubular wail in order to selectively engage at least one respective cooling fin thereon.

7. A fluid manifold according to claim 1, wherein the tubular wall further comprises a concavity formed therein, the concavity being open towards the at least one plane of contact between the at least two circumferentially spaced points of contact.

* * * * *